US006964181B1

(12) United States Patent
Milios et al.

(10) Patent No.: US 6,964,181 B1
(45) Date of Patent: Nov. 15, 2005

(54) OPTIMIZED HEATING VALUE IN NATURAL GAS LIQUIDS RECOVERY SCHEME

(75) Inventors: Paul Barton Milios, Katy, TX (US); Hazem Haddad, Houston, TX (US); David C. Vogel, Houston, TX (US); Sanjiv N. Patel, Sugar Land, TX (US); Jorge H. Foglietta, Missouri City, TX (US)

(73) Assignee: ABB Lummus Global Inc., Houston, TX (US)

( * ) Notice: Subject to any disclaimer, the term of this patent is extended or adjusted under 35 U.S.C. 154(b) by 86 days.

(21) Appl. No.: 10/651,178

(22) Filed: Aug. 28, 2003

Related U.S. Application Data

(60) Provisional application No. 60/406,502, filed on Aug. 28, 2002.

(51) Int. Cl.[7] ..... F25J 3/00; F25J 1/00
(52) U.S. Cl. ..... 62/620; 62/613
(58) Field of Search ..... 62/620, 617, 611, 62/613, 625

(56) References Cited

U.S. PATENT DOCUMENTS

| | | | | |
|---|---|---|---|---|
| 2,815,650 | A * | 12/1957 | McIntire et al. | 95/180 |
| 3,420,068 | A | 1/1969 | Petit | |
| 3,837,172 | A | 9/1974 | Markbreiter et al. | |
| 4,479,871 | A | 10/1984 | Pahade et al. | |
| 5,114,451 | A | 5/1992 | Rambo et al. | |
| 5,755,115 | A | 5/1998 | Manley | |
| 6,510,706 | B2 | 1/2003 | Stone et al. | |
| 6,564,579 | B1 * | 5/2003 | McCartney | 62/620 |
| 6,604,380 | B1 * | 8/2003 | Reddick et al. | 62/620 |
| 2002/0029585 | A1 | 3/2002 | Stone et al. | |
| 2002/0042550 | A1 | 4/2002 | Pironti et al. | |
| 2002/0166336 | A1 | 11/2002 | Wilkinson et al. | |
| 2003/0005722 | A1 | 1/2003 | Wilkinson et al. | |

FOREIGN PATENT DOCUMENTS

| | | | |
|---|---|---|---|
| DE | 36 33 445 | A1 | 4/1988 |
| JP | 60092223 | A | 10/1983 |
| JP | 60092222 | A | 5/1985 |

* cited by examiner

*Primary Examiner*—William C. Doerrler
(74) *Attorney, Agent, or Firm*—Bracewell & Giuliani LLP

(57) ABSTRACT

A process and apparatus for controlling or reducing the heating value or BTU content of NGL recovered from LNG streams. LNG pipelines have a maximum allowable heating value that LNG must be within prior to entering the pipeline. If the LNG heating value is too high, the components contributing to the high heating value must be removed prior to being introduced in the pipeline. The process controls the heating value of the residue LNG gas stream by splitting a feed stream and warming at least a portion of the feed stream. Substantial differences in enthalpy content and temperature between the two portions of the feed stream exist prior to being sent to a fractionation tower.

30 Claims, 1 Drawing Sheet

OPTIMIZED HEATING VALUE IN NATURAL GAS LIQUIDS RECOVERY SCHEME

RELATED APPLICATIONS

This application claims the benefit of a provisional application having U.S. Ser. No. 60/406,502, filed on Aug. 28, 2002, which hereby is incorporated by reference in its entirety.

BACKGROUND OF THE INVENTION

1. Technical Field of the Invention

The present invention relates to the recovery of natural gas liquids, such as propane and ethane, from liquefied natural gas (LNG) streams by means of cold utilization.

2. Description of Prior Art

The supply of LNG varies considerably in composition, depending upon the source of the stream. This composition variation is particularly noticeable in the receiving terminals in the U.S. As a result of this variation, once the LNG is processed, the heating value of the revaporized LNG, or residue gas, from such processes also varies significantly. At times, the residue gas stream produced is lean without significant amounts of relatively heavier compounds, such as ethane and similar compounds. Other times, the residue gas stream can be too high in heating value for residue gas pipelines. Pipelines have specifications that have a maximum allowable heating value, or BTU content, for residue gas streams. If the heating value exceeds the maximum allowable heating value, components contributing to the high BTU content have to be removed or the pipeline operator can reject the residue gas.

Many processes have been developed to separate liquefied natural gas into a methane-rich overhead stream and a bottoms stream containing components such as C2 and heavier hydrocarbons. Examples can be found in U.S. Pat. No. 3,837,172 issued to Markbreiter ("the Markbreiter patent"), U.S. Pat. No. 5,114,451 issued to Rambo ("the Rambo patent"), and U.S. Pat. No. 6,510,706 issued to Stone et al. ("the Stone patent").

The Markbreiter patent shows a process for separating liquefied natural gas in a fractionation column to yield a methane-enriched overhead stream and a bottoms stream that contains C2 and heavier hydrocarbons. Difficulties encountered with the process of Markbreiter include a lack of flexibility in the process to account for varying feed compositions. The Markbreiter process can result in an overhead stream, which is delivered as a vapor stream, with an unacceptably high amount of C2, which can result in rejection of the gas. Since the overhead stream is delivered in vapor form, it is necessary to compress the vapor to deliver it at the conditions of the pipeline.

The Rambo patent shows a process for separating liquefied natural gas in which a portion of a methane-enriched overhead stream from a fractionation column is re-fed to the column as reflux, while the remaining portion of the overhead stream is recovered as a vapor product stream. As with Markbreiter, additional compression steps are required to deliver the vapor at the conditions of the pipeline.

The Stone patent shows a process for removing ethane and heavier components as a liquid NGL product from a pressurized LNG stream. The Stone patent defines the pressurized LNG stream as being pressurized up to a pressure where its bubble point is equivalent to about −170° F. The Stone patent specifically describes the recovery of NGL from pressurized LNG (PLNG). A split is provided for the feed stream to provide cold reflux to the fractionation column. The cold reflux stream is pressurized so that its bubble point temperature is about −170° F., as opposed to conventional LNG processes having a bubble point about −260° F., which reduces separation efficiency within the fractionation column.

A need exists for a flexible process that will control or decrease the heating value of the residue gas produced from typical LNG processes. It would be advantageous to provide a process that will increase the amount of natural gas liquids that are recovered from LNG streams, while decreasing the heating value of the residue gas stream produced by revaporizing the lean LNG stream. It would also be advantageous to provide a process in which the product is delivered at similar conditions as the LNG feed to minimize the intervention in existing terminals and reduce the energy required to supply the gas at pipeline conditions.

SUMMARY OF THE INVENTION

The present invention advantageously provides a process and apparatus to control and decrease heating value of residue gas that is produced from natural gas liquids recovery processes. The process and apparatus additionally provides an increase in the amount of natural gas liquids that are recovered simultaneously with the reduction of the residue gas heating value.

An LNG feed stream received from the atmospheric cryogenic storage tanks is boosted to a pressure that will make re-liquefaction of the product possible later, and then heated in a first, or primary, exchanger in a heat exchanger train, preferably to the bubble point temperature of the feed stream. The feed stream is then split, with a first portion of the feed stream being sent to a tower as a first tower feed stream to a tower.

The tower is preferably a demethanizer or a deethanizer. More specifically the tower preferably is a reboiled absorber that preferably includes a bottom heat source. The bottom heat source can be a kettle reboiler, a thermosyphon reboiler, a plate-fin exchanger, an internal reboiler, a side-reboiler, and combinations thereof. An example plate-fin exchanger is a brazed aluminum exchanger. Other types of bottom heat sources will be known to those skilled in the art and are to be considered within the scope of the present invention.

A secondary portion of the feed stream is heated further in a secondary exchanger in a heat exchanger train and then sent as a second tower feed stream to the tower. A substantial difference in enthalpy content and in temperature exists between the first portion and the secondary portion of the feed stream once the second tower feed stream is heated. The differences in enthalpy content of the two split streams provide the unique ability to control the amount of separation achieved in the tower as the enthalpy difference provides a driving force for separation. It is preferable for the first feed stream to be fed to the tower at a higher location than the second feed stream. The first portion of the feed stream is fed to the top of the tower in this configuration. The tower produces an overhead stream and a natural gas liquids stream. The overhead stream is at least partially condensed by contact with the feed stream in the heat exchanger train to form a residue LNG stream. The natural gas liquids, such as C2+ compounds, that are recovered from the process are substantially contained within the natural gas liquids stream. The primary and secondary heaters can be part of one heat exchanger, such as an LNG heat exchanger.

As an alternate embodiment, the feed stream can be split prior to being heated. A first portion of the feed stream is sent directly to the tower as a first tower feed stream, while a secondary portion is heated and then sent to the tower as a second feed stream. It is preferable for the first tower feed stream to be fed to the tower at a higher location than the second tower feed stream. This alternate embodiment simplifies the heating requirements since only one heat exchanger with one heating path is required, but more than one can be used.

The result of both embodiments of the natural gas liquids recovery process is a decrease in the heating value of the residue gas LNG stream. The reduced heating value of the residue gas stream keeps the gas within the pipeline specifications. The recovery of natural gas liquids, such as C2+ compounds, provides a valuable source of revenue. Both embodiments are believed to be equally effective, with the second embodiment requiring less capital costs since less process equipment is needed.

In addition to the processes embodiments provided, the apparatus used to perform the process embodiments is also advantageously provided. The apparatus preferably includes a first pump, a first heat exchanger, a means for splitting the feed stream, optionally a second heat exchanger, a tower, and a second pump. The tower can be a deethanizer or a demethanizer depending upon the desired NGL products and composition of the feed stream. The second heat exchanger is not required in the second apparatus embodiment. A means for revaporizing the residue LNG stream can also be provided.

BRIEF DESCRIPTION OF THE DRAWINGS

So that the manner in which the features, advantages and objects of the invention, as well as others that will become apparent, may be understood in more detail, more particular description of the invention briefly summarized above may be had by reference to the embodiment thereof that are illustrated in the appended drawings, which form a part of this specification. It is to be noted, however, that the drawings illustrate only a preferred embodiment of the invention and are therefore not to be considered limiting of the invention's scope as it may admit to other equally effective embodiments.

DETAILED DESCRIPTION

Figure 1:
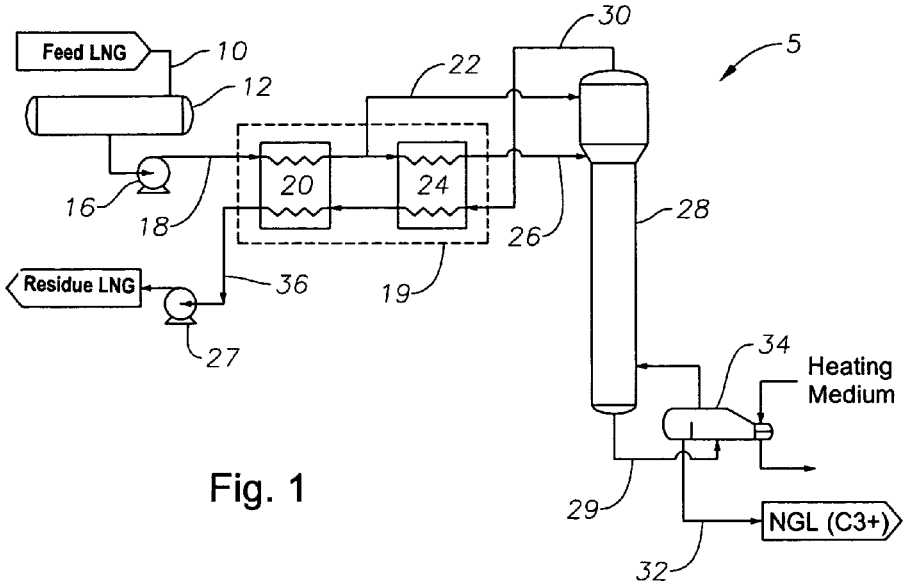
FIG. 1 is a simplified flow diagram of a natural gas liquids recovery process that incorporates the improvements of the present invention and is configured for decreased heating value of a residue gas produced in the natural gas liquids recovery process.
Figure 2:
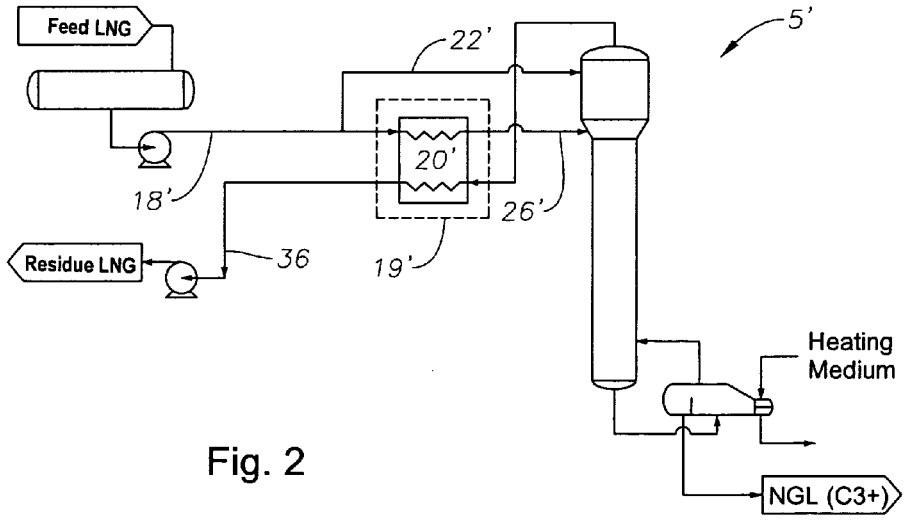
FIG. 2 is a simplified flow diagram of an alternate natural gas liquids recovery process that incorporates the improvements of the present invention and is configured with a simplified heat exchanger train.

For simplification of the drawings, figure numbers are the same in FIG. 1 and FIG. 2 for various streams and equipment when the functions are the same, with respect to the streams or equipment, in each of the figures. Like numbers refer to like elements throughout, and prime, double prime, and triple prime notation, where used, generally indicate similar elements in alternative embodiments.

The term "natural gas liquid" refers to hydrocarbons found in natural gas that can be extracted or isolated as liquefied petroleum gas and natural gasoline. When natural gas is produced, it contains methane and other light hydrocarbons that are separated in a gas processing plant. The natural gas liquids components recovered during processing include C2+ compounds, such as ethane, propane, and butane, as well as heavier hydrocarbons. The products, known as natural gas liquids (NGL), can be used as fuel or raw materials in industrial production.

FIG. 1 illustrates one embodiment of the optimized heating value of natural gas liquids scheme 5. In this scheme 5, a process for controlling the heating value of a produced residue LNG stream 36 from a feed LNG stream is advantageously provided. Inlet feed gas stream 10, which is a rich or heavy LNG stream, is supplied by sending the inlet feed gas stream 10 to an LNG storage vessel 12 from where its pressure is boosted, preferably by pumping with a pump 16, which forms a subcooled feed stream 18. The pressure of feed stream 18 preferably is in a range of about 50 psig to about 500 psig. This pressure range allows for re-liquefying the residue LNG stream 36. The feed stream 18 is heated, or warmed, in a heat exchanger train 19 preferably by heat exchange contact with a cooled overhead stream 30. The step of heating feed stream 18 provides a portion of the cooling required for the step of further cooling overhead stream 30 to produce the residue LNG stream 36.

In this embodiment of the present invention, the heat exchanger train 19 preferably contains two exchangers, a first exchanger 20 and a second exchanger 24. The feed stream 18, which is subcooled, is heated to its bubble point temperature in first exchanger 20 by heat exchange contact with a cooled overhead stream 30. The higher feed stream 18 is split into a first portion and a secondary portion. The first portion is fed to a tower 28 as a first tower feed stream 22. The step of splitting feed stream 18 into a first and second tower feed stream 22, 26 includes first tower feed stream 22 being in a range of about 5% to about 50% of feed stream 18 and second tower feed stream 26 being in a range of about 50% to about 95% of feed stream 18. Overhead stream 30 preferably has a methane concentration in a range of about 85 wt. % to about 99 wt. %.

The secondary portion of feed stream 18 is further warmed in second exchanger 24 by heat exchange contact with overhead stream 30. Second tower feed stream 26 is heated or warmed so that there is a substantial difference in the enthalpy content of first tower feed stream 22 and second tower feed stream 26. The differences in enthalpy content of the two split streams provide the unique ability to control the amount of separation achieved in the tower as this enthalpy difference provides a driving force for separation. As can be seen in Table 1, the substantial difference in enthalpy content can be in a range of about 75 Btu/lb to about 150 Btu/lb. Additionally, a substantial difference in temperatures also exists between the two streams 22, 26. The temperature difference between the two streams is preferably in a range of about 25° F. to about 50° F. In all embodiments of this invention, first and second exchangers 20, 24 can be a single multi-path exchanger, a plurality of individual heat exchangers, or combinations thereof. The warmed feed stream exits the second exchanger 24 as a second tower feed stream 26. Second tower feed stream 26 is preferably sent to tower 28 below the first tower feed stream 22.

TABLE 1

| | Temperature | | Pressure | | Enthalpy |
|---|---|---|---|---|---|
| Stream No. (FIG. 1) | ° C. | ° F. | KPa | Psia | BTU/lb |
| 10 | −151.1 | −240 | 517.1 | 75 | −2094 |
| 18 (before 20) | −149.6 | −237.2 | 3275.0 | 475 | −2094 |
| 18 (after 20) | −87.4 | −125.4 | 3240.5 | 470 | −2003 |

TABLE 1-continued

| Stream No. (FIG. 1) | Temperature ° C. | Temperature ° F. | Pressure KPa | Pressure Psia | Enthalpy BTU/lb |
|---|---|---|---|---|---|
| 22 | −87.4 | −125.4 | 3240.5 | 470 | −2003 |
| 26 (before 24) | −87.4 | −125.4 | 3240.5 | 470 | −2003 |
| 26 (after 24) | −70.3 | −94.59 | 3240.5 | 470 | −1902 |
| 30 (before 24) | −58.1 | −72.56 | 3137.1 | 455 | −1917 |
| 30 (before 20) | −84.4 | −120 | 3116.4 | 452 | −2016 |
| 30 (after 24 and 20) | −109.6 | −165.3 | 3082.0 | 447 | −2117 |
| 30 (after 27) | −104.6 | −156.2 | 8377.0 | 1215 | −2117 |

Tower 28 is preferably a reboiled absorber that uses a bottom heat source, such as a bottoms reboiler 34, to maintain specification of a residue gas stream. Other examples of suitable bottom heat sources include a kettle reboiler, a thermosyphon reboiler, a plate-fin exchanger, an internal reboiler, a side-reboiler, and combinations thereof. An example plate-fin exchanger is a brazed aluminum exchanger. Other types of bottom heat sources will be known to those skilled in the art and are to be considered within the scope of the present invention. A reboiled absorber typically contains a stripping section and an absorption section within the same tower. Bottoms reboiler 34 uses a heating medium stream to provide heat to tower 28. The heating medium can be steam or a heat transfer fluid. Other examples of heating medium will also be known to those skilled in the art and are to be considered within the scope of the present invention.

In tower 28, the rising vapors in a reboiler reflux stream are at least partially condensed by intimate contact with falling liquids from first and second tower feed streams 22, 26 thereby producing overhead stream 30. The condensed liquids descend down tower 28 and are removed as a natural gas liquids stream 29, which contains a majority of the natural gas liquids recovered from feed stream 10. Natural gas liquids stream 29 is sent to bottoms reboiler 34. A portion of natural gas liquids stream 29 is drawn from bottoms reboiler 34 as a natural gas liquids stream 32.

The net heating value of the process is optimized by increasing the recovery of natural gas liquids, while simultaneously decreasing the heating value of the residue gas stream, which is formed by revaporizing residue LNG stream 36. This configuration allows the degrees of separation to be controlled so tower 28 is flexible enough to handle various feed compositions of the LNG feed stream, while improving specifications of residue LNG stream 36. The control of the split of the two streams that are being fed as first and second feed streams to the tower provides a means to control the degree of separation. The differences in enthalpy content of the two split streams provide the unique ability to control the amount of separation achieved in the tower. A predetermined enthalpy difference drives the amount of separation achieved.

Overhead stream 30 is a lean residue gas stream that is sent to second exchanger 24 and is cooled by heat exchange contact with second tower feed stream 26 to produce a cooled tower overhead stream. The step of warming second tower feed stream 26 provides at least a portion of the cooling required for cooling tower overhead stream 30. Overhead stream 30 is further cooled in first exchanger 20 preferably by heat exchange contact with feed stream 18. The condensed liquid from the overhead stream 30 forms a residue LNG stream 36 that is sent, typically by pumping with main pumps 27, for revaporization to produce a residue gas stream. The residue gas stream produced from the residue LNG stream 36 has a reduced heating value in order to meet pipeline specifications for heating values of residue gas streams.

The apparatus to perform the process illustrated in FIG. 1 is also advantageously provided as an embodiment of the present invention. The apparatus preferably includes a first pump 16, a first heat exchanger 20, a means for splitting the feed stream 18, a second heat exchanger 24, a tower 28, and a second pump 27.

First pump 16 is used to supply and pump feed stream 10. First heat exchanger 20 warms feed stream 10 to produce a warm feed stream 18, while simultaneously cooling an overhead stream 30. The means for splitting warm feed stream 18 splits warm feed stream 18 into a first tower feed stream 22 and a second tower feed stream 26. Second heat exchanger 24 warms second tower feed stream 26, while simultaneously cooling tower bottoms tower stream 30. Tower 28 receives first tower feed stream 22 and second tower feed stream 26 and produces an overhead stream 30 and a bottoms tower stream 29. Tower 28 preferably includes a reboiled absorber, which preferably includes a bottoms reboiler 34.

FIG. 2 depicts an alternate embodiment for the optimized heating value in a natural gas liquids recovery scheme 5'. In this alternate embodiment, feed stream 18' is split into a first portion and a secondary portion. The pressure of feed stream 18' preferably is in a range of about 50 psig to about 500 psig. The first portion is sent directly to the tower 28 as a first tower feed stream 22'. The secondary portion is warmed in the heat exchanger train 19' prior to being sent to tower 28 as a second tower feed stream 26'. The heat exchanger train 19' preferably contains a first exchanger 20'. Feed stream 18' is heated in first exchanger 20' by heat exchange with overhead stream 30'. Heating feed stream 18' provides a substantial difference in the enthalpy content of first tower feed stream 22' and second tower feed stream 26'. Control of the differences in enthalpy content of the two split streams provides the ability to control the amount of separation achieved in the tower. As shown in Table 2, a difference in enthalpy content in a range of about 150 Btu/lb to about 200 Btu/lb exists between the two streams 22', 26'. Additionally, a substantial temperature difference also exists between the two streams 22', 26'. The substantial temperature difference is preferably in a range of about 110° F. to about 150° F. In this embodiment, overhead stream 30' is cooled in the first exchanger 20' by heat exchange contact with the remaining portion of the feed stream 18'.

TABLE 2

| Stream No. (FIG. 2) | Temperature ° C. | Temperature ° F. | Pressure KPa | Pressure Psia | Enthalpy BTU/lb |
|---|---|---|---|---|---|
| 10 | −151.1 | −240 | 517.1 | 75 | −2094 |
| 18' | −149.8 | −237.6 | 2930.3 | 425 | −2094 |
| 22' | −149.8 | −237.6 | 2930.3 | 425 | −2094 |
| 26' (before 20') | −149.8 | −237.6 | 2930.3 | 425 | −2094 |
| 26' (after 20') | −76.7 | −106.1 | 2895.8 | 420 | −1912 |
| 30 (before 20') | −62.0 | −79.67 | 2792.4 | 405 | −1922 |
| 30 (after 20') | −102.6 | −152.6 | 2757.9 | 400 | −2109 |
| 30 (after 27) | −96.3 | −141.3 | 8377.0 | 1215 | −2109 |

Both embodiments of the present invention provide for the decrease in residue gas heating value and increase in the amount of the recovered natural gas liquids. This alternate embodiment 5' has a simplified heat exchanger train 19', as opposed to the heat exchanger train 19 shown in FIG. 1, which results in additional reduction in capital costs.

As an advantage of this invention, the residue gas streams are able to remain below the heating value specification required in most pipelines. The heating value that is removed from the residue gas stream, which is produced from the residue LNG stream 36, is captured by the increase in the amount recovered of the natural gas liquids from the rich LNG feed stream 10. Since natural gas liquids streams contain valuable compounds, particularly when sales prices of the compounds are high, it is advantageous to recover more of these compounds from rich LNG streams.

While the invention has been shown or described in only some of its forms, it should be apparent to those skilled in the art that it is not so limited, but is susceptible to various changes without departing from the scope of the invention.

For example, various means of heat exchange can be used to supply the bottoms reboiler with heat. The reboiler can be more than one exchanger or be a single multi-pass exchanger. Equivalent types of reboilers will be known to those skilled in the art. As another example, a separate stripper and absorber can be used instead of a reboiled absorber.

We claim:

1. A process for controlling a heating value of a produced residue LNG stream from a feed LNG stream rich in compounds such C2+ compounds, the process comprising the steps of:

supplying and pumping a feed stream to a pressure that allows re-liquefaction of a residue LNG stream;

warming the feed stream to a first temperature defining a first enthalpy;

splitting the feed stream into a first tower feed stream and a second tower feed stream;

warming the second tower feed stream to a second temperature different from the first temperature defining a second enthalpy different from the first enthalpy;

supplying a tower with the first and second tower feed streams, the tower producing an overhead stream and a natural gas liquids stream;

cooling and then pumping the tower overhead stream to produce the residue LNG stream; and allowing for the splitting of the feed stream such that the natural gas liquids stream contains a major portion of the recovered C2+ compounds and the tower overhead stream has a methane concentration in a predefined concentration range.

2. The process according to claim 1, wherein the step of supplying and pumping a feed stream to a pressure that allows re-liquefaction of a residue LNG stream including pumping the feed stream to a pressure in a range of about 50 psig to about 500 psig.

3. The process according to claim 1, wherein the methane concentration has a predefined concentration range of about 85 wt. % to about 99 wt. %.

4. The process according to claim 1, wherein the step of supplying a tower with the first and second tower feed streams includes supplying the first tower feed stream at a higher tower feed location than the second tower feed stream.

5. The process according to claim 1, whereby the step of warming the feed stream includes warming the feed stream to about bubble point temperature.

6. The process according to claim 1, wherein the step of warming the second tower feed stream includes warming the second tower feed stream so that there is a substantial difference in an enthalpy content in the first tower feed stream and the second tower feed stream in a range of about 75 Btu/lb to about 150 Btu/lb.

7. The process according to claim 1, wherein the step of warming the second tower feed stream includes warming the second tower feed stream so that there is a substantial difference in temperature between the first tower feed stream and the second tower feed stream in a range of about 25° F. to about 50° F.

8. The process according to claim 1, wherein the step of splitting the feed stream into a first and second tower feed stream includes the first tower feed stream being in a range of about 5% to about 50% of the feed stream and the second tower feed stream being in a range of about 50% to about 95% of the feed stream.

9. The process according to claim 1, wherein the step of warming the second tower feed stream includes warming the second tower feed stream by heat exchange contact with the overhead stream, thereby providing at least a portion of the cooling required for the step of cooling the overhead stream to produce a cooled overhead stream.

10. The process according to claim 9, wherein the step of warming the feed stream includes warming the feed stream by heat exchange contact with the cooled overhead stream, thereby providing a remaining portion of the cooling required for the step of cooling the overhead stream to produce a lean LNG stream.

11. The process according to claim 1, wherein the step of cooling the overhead stream includes cooling the overhead stream by heat exchange contact with a process stream selected from the group consisting of the feed stream, the second tower feed stream, an external cooling stream, and combinations thereof.

12. The process according to claim 1, further including vaporizing the residue LNG stream to produce a residue gas stream within pipeline specifications.

13. An apparatus for controlling a heating value of a produced residue LNG stream from a feed LNG stream rich in C2+ compounds, the apparatus comprising:

a first pump for supplying and pumping a feed stream to a pressure such that allows re-liquefaction of a residue LNG stream;

at least one heat exchanger for warming the feed stream and cooling an overhead stream;

a means for splitting the feed stream into a first tower feed stream and a second tower feed stream;

at least one second heat exchanger for warming the second tower feed stream and cooling the overhead stream;

a tower for receiving the first tower feed stream and the second tower feed stream, and for producing the overhead stream and a bottoms tower stream; and a second pump for pumping the overhead stream to produce the residue LNG stream;

such that the natural gas liquids stream contains the major portion of the recovered C2+ compounds and the overhead stream has a methane concentration in a predefined concentration range.

14. The apparatus of claim 13, wherein the tower is a reboiled absorber.

15. The apparatus of claim 13, wherein the tower includes a bottom heat source.

16. The apparatus of claim 15, wherein the bottom heat source is selected from a bottoms exchanger selected from the group consisting of a kettle reboiler, a thermosyphon reboiler, a plate-fin exchanger, an internal reboiler, a side-reboiler, and combinations thereof.

17. A process for controlling a heating value of a produced residue LNG stream from a feed LNG stream rich in components like C2+ compounds, the process comprising the steps of:

supplying and pumping a feed stream to a pressure that allows re-liquefaction of a residue LNG stream;

splitting the feed stream into a first tower feed stream having a first temperature and defining a first enthalpy and a second tower feed stream;

warming the second tower feed stream in a heat exchanger in cross-exchange solely with an overhead stream to a second temperature different from the first temperature defining a second enthalpy different from the first enthalpy;

supplying a tower with the first and second tower feed streams, the tower producing the overhead stream and a bottoms tower stream;

supplying the overhead stream from the tower to the heat exchanger without compressing the overhead stream;

cooling and then pumping the overhead stream, thereby producing the residue LNG stream; and allowing for the split of the feed stream such that the natural gas liquids stream contains a major portion of the recovered C2+ compounds and the tower overhead stream has a methane concentration in a predefined concentration range.

18. The process according to claim 17, wherein the step of supplying and pumping a feed stream to a pressure that allows re-liquefaction of a residue LNG stream including pumping the feed stream to a pressure in a range of about 50 psig to about 500 psig.

19. The process according to claim 17, wherein the methane concentration has a predefined concentration range of about 85% to about 99%.

20. The process according to claim 17, wherein the step of supplying a tower with the first and second tower feed streams includes supplying the first tower feed stream at a higher tower feed location than the second tower feed stream.

21. The process according to claim 17, wherein the step of warming the second tower feed stream includes warming the second tower feed stream so that there is a substantial difference in an enthalpy content in the first tower feed stream and the second tower feed stream in a range of about 150 Btu/lb to about 200 Btu/lb.

22. The process according to claim 17, wherein step of warming the second tower feed stream includes warming the second tower feed stream so that there is a substantial temperature difference between the first tower feed stream and the second tower feed stream in a range of about 110° F. to about 140° F.

23. The process according to claim 17, wherein the step of splitting the feed stream into a first and second tower feed stream includes the first tower feed stream being in a range of about 5% to about 50% of the feed stream and the second tower feed stream being in a range of about 50% to about 95% of the feed stream.

24. The process according to claim 22, wherein the step of warming the second tower feed stream includes warming the second tower feed stream by heat exchange contact with the overhead stream, thereby providing cooling for the step of cooling the overhead stream to produce a lean LNG stream.

25. The process according to claim 17, wherein the step of cooling the overhead stream includes cooling the overhead stream by heat exchange contact with a process stream selected from the group consisting of the second tower feed stream, an external cooling stream, and combinations thereof.

26. The process according to claim 17, further including vaporizing the residue LNG stream to produce a residue gas stream within pipeline specifications.

27. An apparatus for controlling heating value of a produced lean LNG stream from a rich LNG stream, the apparatus comprising:

a first pump for supplying and pumping a feed stream to a pressure that allows re-liquefaction of a residue LNG stream;

a means for splitting the feed stream into a first tower feed stream and a second tower feed stream;

at least one heat exchanger for warming the second tower feed stream and cooling an overhead stream such that the second tower feed stream is warmed in cross-exchange solely with the overhead stream;

a tower for receiving the first tower feed stream and the second tower feed stream, and for producing the overhead stream and a natural gas liquids stream, such that the overhead stream from the tower is directed to the heat exchanger for cooling without being compressed; and a second pump for pumping the overhead stream to produce the residue LNG stream;

such that the natural gas liquids stream contains a major portion of the recovered C2+ compounds and the tower overhead stream has a methane concentration in a predefined concentration range.

28. The apparatus of claim 27, wherein the tower is a reboiled absorber.

29. The apparatus of claim 28, wherein the tower includes a bottom heat source.

30. The apparatus of claim 29, wherein the bottom heat source is a kettle reboiler, a thermosyphon reboiler, a plate-fin, an internal reboiler, a side-reboiler, and combinations thereof.

* * * * *